US008316876B2

(12) United States Patent
McKeague

(10) Patent No.: US 8,316,876 B2
(45) Date of Patent: Nov. 27, 2012

(54) FLUSHING DEVICE WITH REMOVABLE DRAIN RING FOR POTABLE WATER SYSTEMS

(75) Inventor: Daniel G. McKeague, Kirkwood, MO (US)

(73) Assignee: John C. Kupferle Foundry Company, St. Louis, MO (US)

( * ) Notice: Subject to any disclaimer, the term of this patent is extended or adjusted under 35 U.S.C. 154(b) by 632 days.

(21) Appl. No.: 12/502,820

(22) Filed: Jul. 14, 2009

(65) Prior Publication Data

US 2010/0012198 A1 Jan. 21, 2010

Related U.S. Application Data

(60) Provisional application No. 61/081,601, filed on Jul. 17, 2008.

(51) Int. Cl.
*F16K 3/30* (2006.01)
*E03B 9/02* (2006.01)

(52) U.S. Cl. ..... 137/307; 137/302; 137/520; 137/521; 137/855; 137/527.8; 137/107; 251/303

(58) Field of Classification Search ..... 137/300–302, 137/272, 315.41, 307, 308, 294, 240, 847, 137/855, 852, 527, 527.2, 527.6, 527.8, 107, 137/519–521; 251/303
See application file for complete search history.

(56) References Cited

U.S. PATENT DOCUMENTS

| | | | | |
|---|---|---|---|---|
| 683,945 | A * | 10/1901 | Kennedy | 137/107 |
| 1,021,537 | A * | 3/1912 | O'Shields | 137/107 |
| 1,297,001 | A * | 3/1919 | Lawnin | 137/107 |
| 4,483,361 | A * | 11/1984 | Jungbert, Sr. | 137/301 |
| 4,756,479 | A | 7/1988 | Lazenby, III | |
| 5,201,338 | A | 4/1993 | McKeague | |
| 5,921,270 | A | 7/1999 | McCarty | |
| 6,035,704 | A | 3/2000 | Newman | |
| 6,062,259 | A | 5/2000 | Poirer | |
| 6,358,408 | B1 | 3/2002 | Newman | |
| 6,467,498 | B1 | 10/2002 | Esmailzadeh | |
| 6,663,079 | B1 | 12/2003 | Bottenfield | |
| 6,719,004 | B2 * | 4/2004 | Huber et al. | 137/362 |
| 7,228,868 | B2 * | 6/2007 | Kang | 137/301 |
| 7,401,620 | B2 * | 7/2008 | Ball | 137/301 |
| 2004/0238028 | A1 | 12/2004 | Taylor et al. | |
| 2004/0238037 | A1 | 12/2004 | Taylor et al. | |
| 2004/0238458 | A1 | 12/2004 | Taylor et al. | |
| 2004/0252556 | A1 | 12/2004 | Taylor et al. | |

* cited by examiner

*Primary Examiner* — Kevin Lee
(74) *Attorney, Agent, or Firm* — Polster, Lieder, Woodruff & Lucchesi, L.C.

(57) ABSTRACT

A drain ring adapted for use in a device for flushing a dead-end of an underground municipal water distribution system includes a pair of annular seals and a channel between the seals, an outlet passage extending from inside the ring to the channel, and a flapper adapted to close the outlet passage under the influence of at least one of pressure and flow. The drain ring is removably positioned between a shut-off valve and an outlet of the device.

21 Claims, 4 Drawing Sheets

FLUSHING DEVICE WITH REMOVABLE DRAIN RING FOR POTABLE WATER SYSTEMS

CROSS-REFERENCE TO RELATED APPLICATIONS

This application is related to U.S. Provisional Patent Application No. 61/081,601, filed Jul. 17, 2008, from which priority is claimed, and the disclosure of which is hereby incorporated by reference.

STATEMENT REGARDING FEDERALLY SPONSORED RESEARCH

Not applicable.

BACKGROUND OF THE INVENTION

This invention relates to hydrants or valves attached to municipal water systems, and in particular to a simple blow-off device for flushing portions of water systems.

The need for periodically flushing portions of water systems, particularly dead-ends in the systems, has been recognized for many years, as shown for example in Lazenby III, U.S. Pat. No. 4,756,479. A summary of many of the problems requiring such flushing, as well as of the traditional solutions to those problems, is contained in my co-owned U.S. Pat. No. 5,201,338. More recently, such flushing operations have been automated, as described in McCarty, U.S. Pat. No. 5,921,270. The McCarty patent is owned by a company related to the assignee of the present invention. A similar approach is described in Newman, U.S. Pat. Nos. 6,035,704 and 6,358,408. Other approaches are shown in Poirer, U.S. Pat. No. 6,062,259, and Esmailzadeh, U.S. Pat. No. 6,467,498, and in Taylor et al, published applications US 20040252556, US 20040238458, US 20040238037, and US 20040238028.

Although the prior art systems have met with success, the complexity of the systems, the time and effort required to install and use them, the difficulties attendant to removing and servicing them, and their consequent expense have limited their use.

In some situations, the initial cost of the flushing system outweighs the cost of operating it. In these situations, a simple blow-off system comprising an underground manual valve is provided, and water is flushed through an above-ground discharge pipe. The discharge pipe is commonly a 2" or 3" diameter piece of plastic pipe, such as PVC, with an elbow at its free end. These systems are generally fabricated on-site. It is desirable to provide a drain in the discharge pipe below the frost line. The valves commonly used for such installations (for example, resilient seat gate valves), however, do not include an automatic drain. An example of a resilient seat gate valve is that disclosed in Bottenfield, U.S. Pat. No. 6,663,079. Without a drain, water remaining in the discharge pipe downstream of the manual valve is liable to freeze and damage the discharge pipe. If a drain hole is drilled into the discharge pipe below the frostline, it is open at all times, causing erosion of surrounding soil and possible contamination of the water supply.

BRIEF SUMMARY OF THE INVENTION

Briefly stated, one aspect of the present invention provides an automatic drain for a discharge pipe, the drain being designed to be removable from the pipe. The drain is preferably in the form of a ring having an annular channel between vertically spaced, generally horizontal o-rings. A passage between the interior of the ring and the annular channel is closed by a flapper shaped to be pushed closed by flowing water or line pressure when the manual valve is opened, but which is biased open against the pressure of water standing in the discharge pipe above it when the manual valve is closed.

Another aspect of the invention provides a plastic discharge pipe with a provision for removably mounting an automatic drain device.

Other aspects of the invention will be apparent to those skilled in the art in light of the following description of illustrative embodiments of the invention. It will be understood by those skilled in the art that many of the features and components of the foregoing patents and applications may be utilized in embodiments of the present invention. All the foregoing patents and applications are hereby incorporated by reference.

BRIEF DESCRIPTION OF THE SEVERAL VIEWS OF THE DRAWINGS

In the accompanying drawings which form part of the specification.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
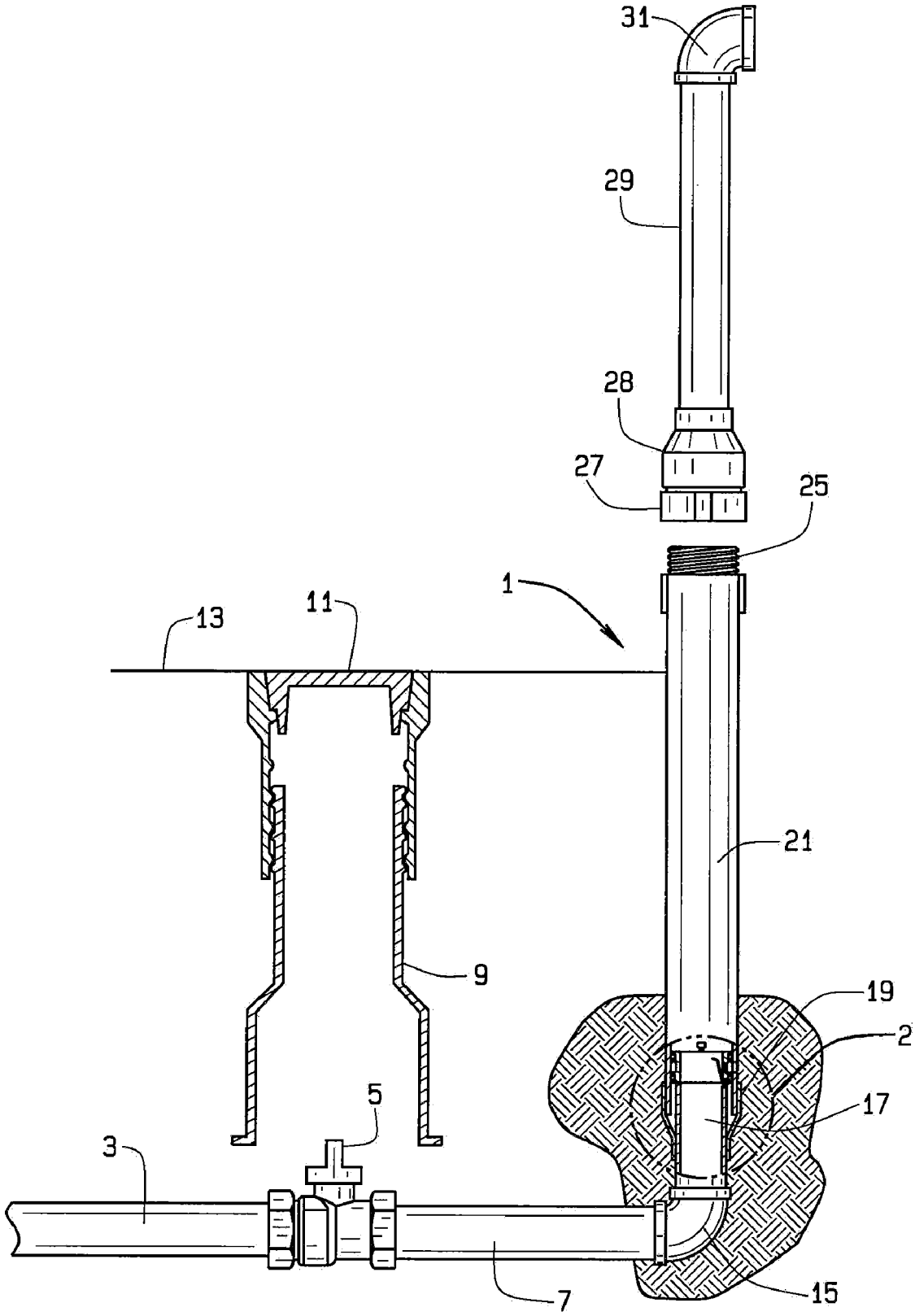
FIG. 1 is a diagrammatic view in partial cross section, showing a flushing device in accordance with one embodiment of the present invention.

As shown in FIG. 1, an illustrative embodiment of the invention includes a blow-off flushing device 1 attached to an underground water main 3 through a shut-off valve 5. Although the type of shut-off valve is immaterial to the present invention, the valve 5 is illustratively a ball valve having an upstream fitting adapted for the main 3, and a downstream fitting adapted to receive a two-inch horizontal PVC pipe 7, which may form a part of the blow-off 1. The valve 5 is at the bottom of a valve box 9 with a cover 11 at or slightly above ground level 13, as is well known in the art.

Figure 2:
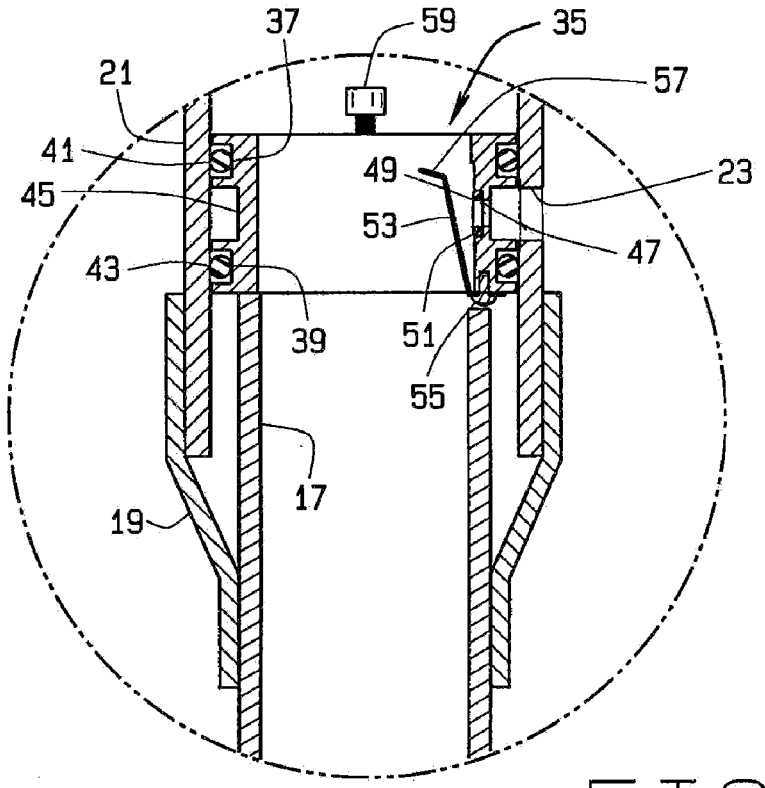
FIG. 2 is a detail of a portion of the hydrant of FIG. 1, showing a drain ring in accordance with the invention seated in the hydrant while the hydrant is flushing.
Figure 3:
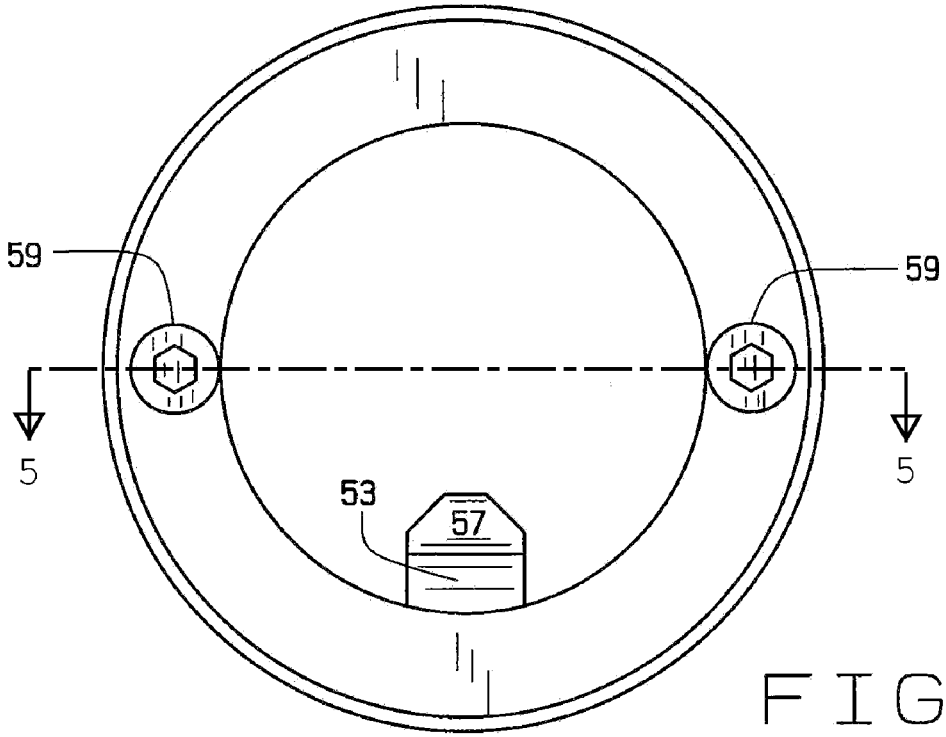
FIG. 3 is a top plan view of a drain ring of the device of FIGS. 1-2.
Figure 4:
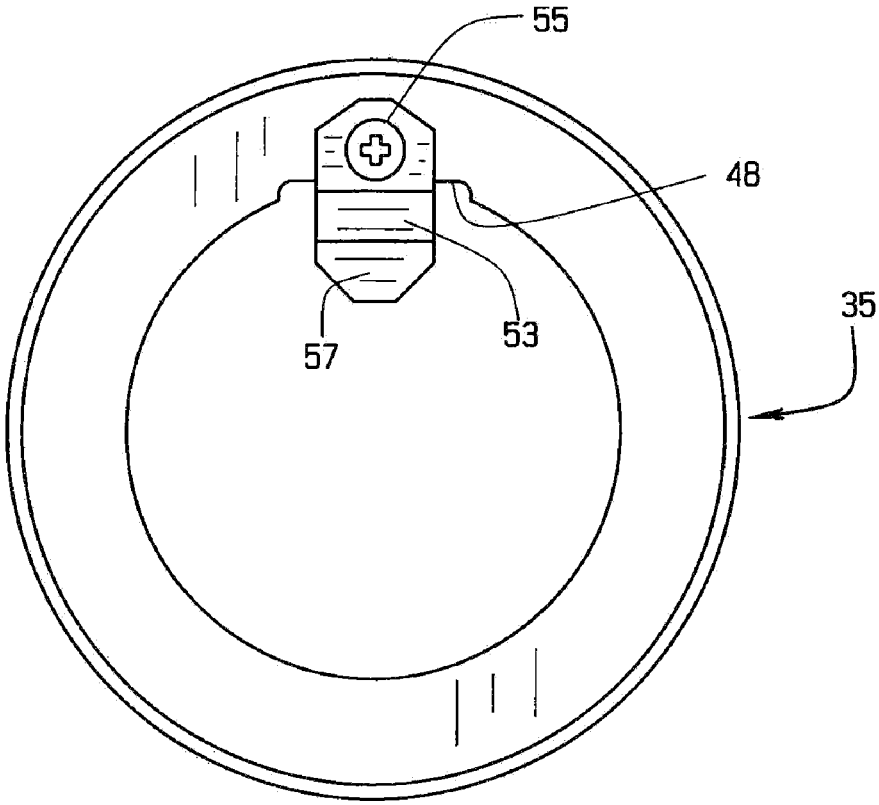
FIG. 4 is a bottom plan view of the drain ring of FIG. 3.
Figure 5:
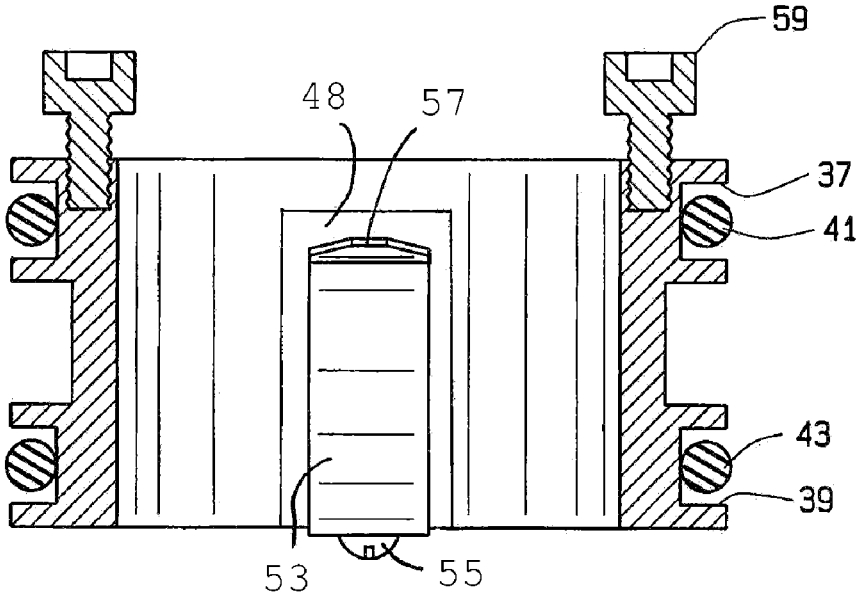
FIG. 5 is a sectional view taken along line 5-5 of FIG. 3.
Figure 6:
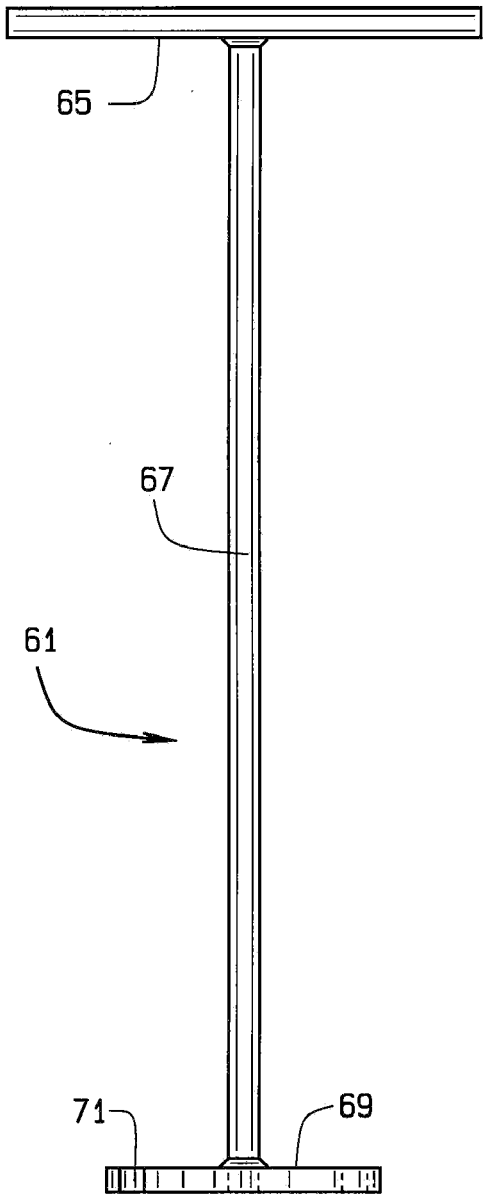
FIG. 6 is a view in side elevation of a tool for removing the drain ring of FIGS. 3-5 from the flushing device of FIGS. 1-2.
Figure 7:
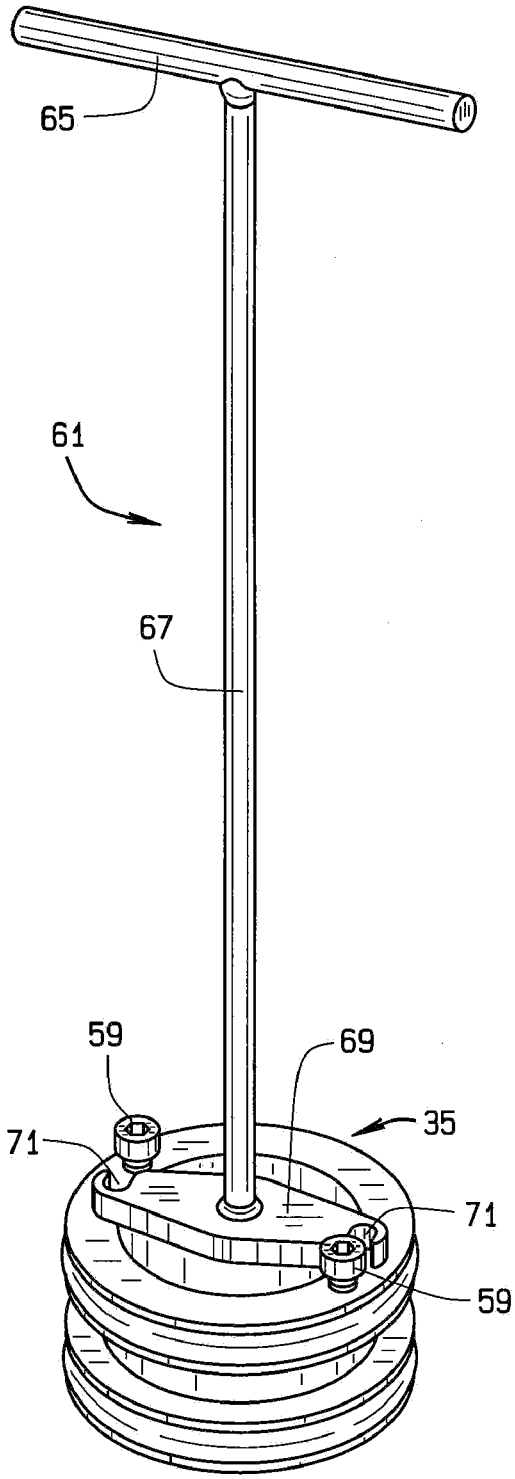
FIG. 7 is a view in perspective showing the tool of FIG. 6 being utilized to engage the drain ring of FIGS. 3-5.

The downstream end of the pipe 7 is attached by an elbow 15 to a vertical two-inch PVC stub pipe 17. The stub pipe 17 has adhered to it a 2"×3" reducer 19. The reducer 19 is modified by removal of the usual shoulder, so as to allow the stub pipe 17 to extend through the reducer 19 so that the upper ends of the stub pipe 17 and the reducer 19 are aligned. The reducer 19 supports the lower end of a three-inch vertical pipe 21, which is adhered to the reducer 19. The three-inch vertical pipe 21 is preferably a schedule-40 PVC pipe cut to slightly over the depth of bury of the reducer 19. A 0.375" drain hole 23 (see FIG. 2) is drilled in the three-inch pipe 21, two inches from its bottom. This arrangement places the drain 23 about five inches above the axis of the horizontal pipe 7 and the top of the three-inch pipe 21 slightly above grade 13.

A threaded male hub 25 is adhered around the top of the vertical three-inch pipe 21 for mounting a threaded female socket 27 which carries 2"×3" reducer 28 and a two-inch PVC pipe 29 having a ninety-degree elbow 31 at its upper end. The elbow 31 acts as the outlet for the blow-off 1 and protects it from debris.

The elbow 15, stub pipe 17, and pipe 21, at least to the depth of the drain hole 23, are set in gravel.

As shown in FIGS. 2-5, a drain ring 35 in accordance with the present invention sits on top of the stub pipe 17. The drain ring 35 is made of any desired material, such as PVC or aluminum or stainless steel. It has an inner diameter equal to that of the two-inch stub pipe 17 and an outer diameter slightly smaller than the inner diameter of the three-inch pipe 21. The drain ring 35 includes outer annular grooves 37 and 39 at the upper and lower ends of the ring, respectively, for holding o-rings 41 and 43, respectively. The o-rings 41 and 43 form a snug, water-tight fit with the inside of the three-inch pipe 21. Between the o-rings 41 and 43 is an annular channel 45. A drain passage 47 extends from the inside of the drain ring 35 to the channel 45. A flat 48 extends around the inner end of the drain passage 47 to allow a flapper 53 to close the inner end of the drain passage 47 as described hereinafter. An annular depression 49 at the inner end of the drain passage 47 forms a seat for an o-ring 51. By way of illustration, the drain ring 35 may be 2.95" in outer diameter and 2.00" in inner diameter, with a height of 1.50". The grooves 37 and 39 may be 0.283" in height and 2.660 in diameter, and the channel 45 may be 0.5" in height and 0.280 in diameter. The flat 48 may have a maximum depth of 0.093" and a width of 0.8".

A flapper 53 is formed of 0.004" spring 304 stainless steel, 0.5" wide. The lower end of the flapper 53 is held to the bottom of the drain ring 35 by a screw 55. The free upper end of the flapper 53 has an inturned ear 57, illustratively bent at an angle of 45°. The lower end of the flapper 53 is bent at an angle of slightly greater than 90° so that the flapper 53 is spaced from the o-ring 51 sufficiently to allow water to drain through the passage 47 into the channel 45. Two bolts 59 are partially threaded into the upper face of the drain ring 35 for removal of the drain ring as described hereinafter.

In use, when the valve 5 is opened, conventionally by a valve wrench placed down valve box 9, water flows from water distribution system 3 into supply pipe 7 and upwards through elbow 15. Elbow 15 leads water upward into stub pipe 17 which perfectly aligns water to hit against spring flapper 53 and ear 57, bending spring flapper 53 so that it mates with o-ring 51, thereby closing drain hole 23. O-rings 41 and 43 isolate water flow from cavity 45 and thereby isolate it from drain hole 23. Should the outlet of the blow-off 1 be blocked, the pressure of water in the blow-off will also be sufficient to close the flapper 53.

When the valve 5 is closed, the flapper 53 has sufficient resilience to open against the pressure of water standing above it in the blow-off 1 and permits any water in the blow-off 1 to drain through the passage 47, into channel 45, and out the drain hole 23.

Should the drain ring 35 malfunction, it is easily removed by unscrewing the socket 27 from the hub 25, and inserting a tool 61 into the three-inch pipe 21. The tool 61 includes a handle 65, a stem 67, and a engagement plate 69 having slots 71. The handle 65 is turned so that the slots 71 engage the bolts 59, and the drain ring 35 is pulled out of the pipe 21. The o-rings 41, 43, and 51 and the flapper 53 are easily replaced as needed, and the drain ring 35 is pushed back through a chamfer in the hub 25 onto the top of the stub pipe 17 with the tool 61. The rotational position of the drain ring 35 is not important.

As various changes could be made in the above constructions without departing from the scope of the invention, it is intended that all matter contained in the above description or shown in the accompanying drawings shall be interpreted as illustrative and not in a limiting sense.

Numerous variations in the flushing device of the present invention will occur to those skilled in the art in view of the foregoing disclosure.

Merely by way of illustration, a depression may be formed in the lower surface of the drain ring 35 for the screw 55 and the lower end of the flapper 53, although it has been found that the drain ring's resting on the head of screw 55 does not interfere with the operation of the drain ring or the blow-off 1. Alternatively, a depression for the screw 55 may be formed in the upper end of the stub pipe 17, but this arrangement would require proper rotational alignment of the drain ring 35 by rotating it with the tool 61 until the screw head seated in the depression. Optionally, the flapper 53 may be held by a screw on the inside surface of the drain ring 35. Other materials and sizes of parts may be used. Other valves 5 may be used, including automated valves activated by a timer, water conditions, or other inputs. A one-way (check) valve may be mounted in the drain hole 23 or the drain passage 47 to prevent backflow into the blow-off 1. Multiple drain holes may be provided. Other arrangements for seating the drain ring 35 may be employed.

These variations are merely illustrative.

All of the patents and printed publications mentioned herein are hereby incorporated by reference.

The invention claimed is:

1. A device for flushing a portion of an underground municipal water distribution system, the device comprising:

an inlet adapted for receiving pressurized water from the water distribution system, an outlet fluidly connected to the inlet and adapted for discharging pressurized water from the inlet, a valve adapted for controlling the flow of pressurized water between the inlet and the outlet, and a drain hole and a removable drain ring between the valve and the outlet, the drain ring comprising a valve activated by at least one of flow and pressure to close the drain hole, the removable drain ring being mounted in a first vertical pipe, the drain ring being held frictionally in the first vertical pipe and being slidable with respect to the first vertical pipe.

2. The device of claim 1 wherein the device comprises a second vertical pipe upstream of the drain ring, the second vertical pipe having a diameter smaller than the diameter of the first vertical pipe, and wherein the drain ring has an inner diameter at least as great as the diameter of the second vertical pipe.

3. The device of claim 2 wherein the drain ring has an inner diameter substantially equal to the diameter of the second vertical pipe.

4. The device of claim 1 wherein the drain ring comprises a pair of spaced-apart annular seals engaging the first vertical pipe, a channel between the seals, a passage between an inner portion of the ring and the channel, and a flapper adapted to close the passage under at least one of flow and pressure.

5. The device of claim 4 wherein the channel communicates with the drain hole.

6. The device of claim 4 wherein the flapper comprises a leaf spring held at one end to the drain ring and being biased away from the passage.

7. The device of claim 6 wherein the passage comprises an o-ring positioned to be closed when the leaf spring is pushed toward it by pressure or flow.

8. The device of claim 7 wherein the leaf spring comprises an inturned ear, the leaf spring being pushed toward the o-ring by flow through the device.

9. The device of claim 2 wherein the first vertical pipe and the second vertical pipe are formed of plastic.

10. The device of claim 9 wherein the plastic is polyvinyl chloride.

11. A drain ring adapted for use in a device for flushing a dead-end of an underground municipal water distribution system, the drain ring comprising a pair of annular seals and a channel between the seals, an outlet passage extending from inside the ring to the channel, and a flapper adapted to close the outlet passage under the influence of at least one of pressure and flow.

12. The drain ring of claim 11 wherein the flapper comprises an in-turned ear.

13. The drain ring of claim 11 wherein the flapper is made of spring metal.

14. The drain ring of claim 11 wherein the outlet passage comprises a seal around its periphery inside the drain ring.

15. A device adapted for flushing a portion of an underground municipal water distribution system, the device comprising:

a first vertical pipe having an underground drain hole therein, a removable drain ring slidable with respect to the pipe, the drain ring comprising a pair of spaced-apart annular seals engaging the first vertical pipe, a channel between the seals, a passage between an inner portion of the ring and the channel, and a valve adapted to close the passage under at least one of flow and pressure, the channel being in fluid communication with the drain hole.

16. The device of claim 15 wherein the device comprises a second vertical pipe upstream of the drain ring, the second vertical pipe having a diameter smaller than the diameter of the first vertical pipe, and wherein the drain ring has an inner diameter at least as great as the diameter of the second vertical pipe.

17. The device of claim 16 wherein the drain ring is seated on a top surface of the second vertical pipe.

18. The device of claim 16 wherein the drain ring comprises at least two headed studs extending above a top surface of the drain ring, the headed studs being engageable by a removal tool.

19. A device adapted for flushing a portion of an underground municipal water distribution system comprising an underground horizontal pipe having a shut-off valve therein, the device comprising:

a drain pipe system attached to the horizontal pipe downstream of the valve, the drain pipe system comprising an elbow attached to the horizontal pipe and a first vertical pipe, the drain pipe system having an underground drain hole therein for draining water in the vertical pipe when the shut-off valve is closed, a removable drain assembly in the drain pipe system, the removable drain assembly being sized to pass upward through the vertical pipe and being removable by a tool reaching downward through the pipe to engage the drain assembly, the removable drain assembly comprising a drain valve constructed and positioned to prevent flow from inside the drain pipe system through the drain hole under at least one of flow and pressure.

20. The device of claim 19 wherein the removable drain assembly is coaxial with the vertical pipe.

21. The device of claim 19 further comprising a removable second elbow at an upper end of the vertical pipe.

* * * * *